United States Patent [19]

Todorski

[11] Patent Number: 4,878,483

[45] Date of Patent: Nov. 7, 1989

[54] PLATE HEAT EXCHANGER AND HEATING STOVE WITH THE PLATE HEAT EXCHANGER

[76] Inventor: Zenon Todorski, 198 Westcroft Road, Beaconsfield, Quebec, Canada, H9W 2M3

[21] Appl. No.: 40,571

[22] Filed: Apr. 17, 1987

[30] Foreign Application Priority Data

Sep. 4, 1986 [CA] Canada ..... 517462

[51] Int. Cl.[4] ..... F24B 7/00

[52] U.S. Cl. ..... 126/523; 126/529; 126/77; 165/166; 165/164

[58] Field of Search ..... 126/77, 90 R, 61, 63, 126/67, 523, 529; 165/166, 164

[56] References Cited

U.S. PATENT DOCUMENTS

| | | | |
|---|---|---|---|
| Re. 26,575 | 4/1969 | Volk . | |
| 2,033,402 | 3/1936 | Smith . | |
| 2,052,643 | 9/1936 | Modine . | |
| 2,368,814 | 2/1945 | Fagan . | |
| 2,789,554 | 4/1957 | Dupler | 126/63 |
| 2,814,287 | 11/1957 | Shults . | |
| 3,162,188 | 12/1964 | Tompers . | |
| 3,302,630 | 2/1967 | Volk . | |
| 3,516,397 | 6/1970 | Kimberley . | |
| 4,127,100 | 11/1978 | Baker | 126/61 X |
| 4,308,915 | 1/1982 | Sanders et al. . | |

FOREIGN PATENT DOCUMENTS

| | | |
|---|---|---|
| 969533 | 6/1975 | Canada . |
| 1020930 | 11/1977 | Canada . |
| 1053221 | 4/1979 | Canada . |

*Primary Examiner*—Larry Jones

*Attorney, Agent, or Firm*—Herbert L. Lerner; Laurence A. Greenberg

[57] ABSTRACT

Heating stove which permits essentially two modes of combustion: (a) upwards combustion i.e. with combustion air entering from beneath the grates. (b) downwards from the combustible material i.e. the combustion air enters from above the hearth so that the combustion gases pass downwards through the grates. The modes of combustion being regulated by a device of flaps.

8 Claims, 3 Drawing Sheets

PLATE HEAT EXCHANGER AND HEATING STOVE WITH THE PLATE HEAT EXCHANGER

FIELD OF INVENTION:

This invention relates to a heating stove equipped with a removable plate heat exchanger which serves as a flue gas heat extractor, wood tar condenser and combustor. The heat exchanger also provides means of channeling away flue gas from the "up-flow" or "down-flow" combustion zone. A novel and inexpensive method for the manufacture of the plate type heat exchanger is given.

BACKGROUND TO THE INVENTION:

Heating stoves such as are used in homes have been used for centuries but they never amounted to more than an open fire place used for emergency or a metal box containing a hearth, a charging door and an exhaust leading to a chimney.

The development of the slow combustion type stoves has been plagued with the problem of increased wood tar deposits in the flue ducts. Such deposits eventually catch fire and have been known to consume entire homes and the occupants. One solution to eliminate the chimney fire hazards has been to equip the stove with a catalytic converter which is meant to trap the wood tars and promote more complete combustion thereof. Excessive costs of such catlytists and their containment apart from their dubious performance have not favored wide acceptance of such devices.

Presently the state of the art in the stove heaters has been to add an air jacket around the stove to enhance the efficiency of heat recovery. However, because of space and heat transfer limitations, stoves equipped with air jackets are unable to extract a large portion of recoverable heat which is then lost to the atmosphere.

When analyzing the performance of a heating stove with the aid of heat transfer theory one must realize that a stove with an air jacket is limited in its ability to recover a higher portion of the heat generated by the combustion process. The limiting factor is the overall heat transfer coefficient which is controlled by the velocity of air in the jacket. Also it is difficult to increase the heat transfer area by adding more jacket surface because of space restrictions.

SUMMARY OF THE INVENTION:

The object of this invention is therefore to provide a hearth for the combustible material and a method of controlling the combustion process so as to ensure full combustion of volatile and solid components of wood or other fuels of organic origin. A further object is to provide a means for the extraction of the heat of combustion within the space limitations imposed by the fire place or space available for the heating stove. A heat exchanger is provided to further extract the sensible heat of the flue gas. Such a heat exchanger could be constructed from tubes in the form of a removable bundle. However the initial tooling costs would be high for such a heat exchanger. Further by increasing the heat transfer area, to at least double that of the stove jacket, by means of a tube bundle method would call for closely spaced and small diameter tubes. This would cause a pressure drop on both the air side and flue gas side of the exchanger, as well as lead to plugging of such a heat exchanger.

A design analysis shows that a plate type heat exchanger can provide at least double the amount of heat transfer area as compared to an equivalent tube type heat exchanger. However, in order to economically justify a plate type heat exchanger a new method of fabrication had to be developed for the heat exchanger. A flange locking method was conceived allowing for simple mass production of such plate heat exchanger units. The plates of the unit can be made identical if the shape and size of the heat exchanger plate is a true square.

Another important feature of the construction of the plate heat exchanger is the method of attaching and sealing connecting flanges (44) to the heat exchanger plates. A good way of securing this objective is to form a tail (36) in the plate flange by cutting out slots (32) in the heat exchanger plates. Once made the heat exchanger plates can be assembled together by hand with no need of special tools. A tight lubricating oil may be necessary should the clearances be made on the tight side.

The paper industry has been known to use a plate type heat exchanger for the paper machine economizer for over seventy years. However in the manufacture of such heat exchanger, plates had to be shaped, pressed and then welded together. Such a method of construction is therefore too costly to be considered in the manufacture of wood stoves and fireplace inserts.

The embodiment of this invention is therefore a heating stove with a plate type heat exchanger which provides efficient heat recovery i.e. 80–90%. A higher recovery rate could be obtained, however this would lower the flue gas temperature to the point where the draft necessary to discharge the flue gas through the chimney could not be established. Mounting the plate type heat exchanger (7) in a position predominantly at the back of the heating stove effectively divides it into two essential spaces i.e. primary combustion zone or hearth (8) and heat exchange area occupied by the plate type heat exchanger (7). Because of the large heat exchange area provided by such a design, the flue gas can be cooled enough for the word tar to condense on the heat exchanger plates. The condensation process of the wood tar is enhanced by the fire start-up feature of the stove heater i.e. by opening the first flue gas flap (9) and closing the second flap (11) and "up-flow"combustion is created on the grates and the length of the flue gas passage is doubled.

It is mostly during the start up of fire that a portion of wood tars escape the combustion process, however in the embodiment of this invention the tars are trapped on the plate type heat exchanger. During normal operation of the stove heater i.e. when white hot coals are established on the grates, the position of the flaps (9) and (11) is reversed which causes the chimney draft to pull down through the grates and thus "down-flow" combustion is established. The main feature of the "down-flow" combustion is that the volatile combustibles evolving from the fresh charge of wood have to pass through a bed of white hot coal, ensuring complete and clean combustion. It should be noted that during the down flow cycle the primary air ports (24) located below the grates become secondary air ports and should be temporarily readjusted to ensure complete combustion of the tars which had been deposited on the heat exchanger plates during the fire start up period.

In this embodiment of the stove heater the charging door has an induced air flow cooling jacket. This feature prevents the charging door from overheating to a point where it could cause accidental burns or even fires. Needless to say in order to make the heating stove effective, a source of cooling air under pressure in sufficient quantity is required. This is done by mounting an electrically driven fan on one of the air jacket covers. This cover in the mounted position forms a plenum from which air is distributed to the plate heat exchanger, all the five external air jackets of the stove heater and the jacket of the charging door.

Another embodiment of the plate heat exchanger is to install the heat exchanger inside a fire place in such a manner that all of the flue gases generated in the combustion process are forced to pass through the heat exchanger. The method shown in figure (6) is to connect the heat exchanger flanges to the two externally mounted boxes. One of the boxes provides space for mounting of a suitable air fan. Glass or metal doors can be attached to the boxes to prevent excessive draft which reduces heat recovery of such a system. It should be noted that the embodiment does not require jacketing of the fireplace since heat recovery efficiency can be controlled by the surface area of the heat exchanger.

DESCRIPTION OF THE PREFERRED EMBODIMENTS OF THE STOVE HEATER

Figure 1:
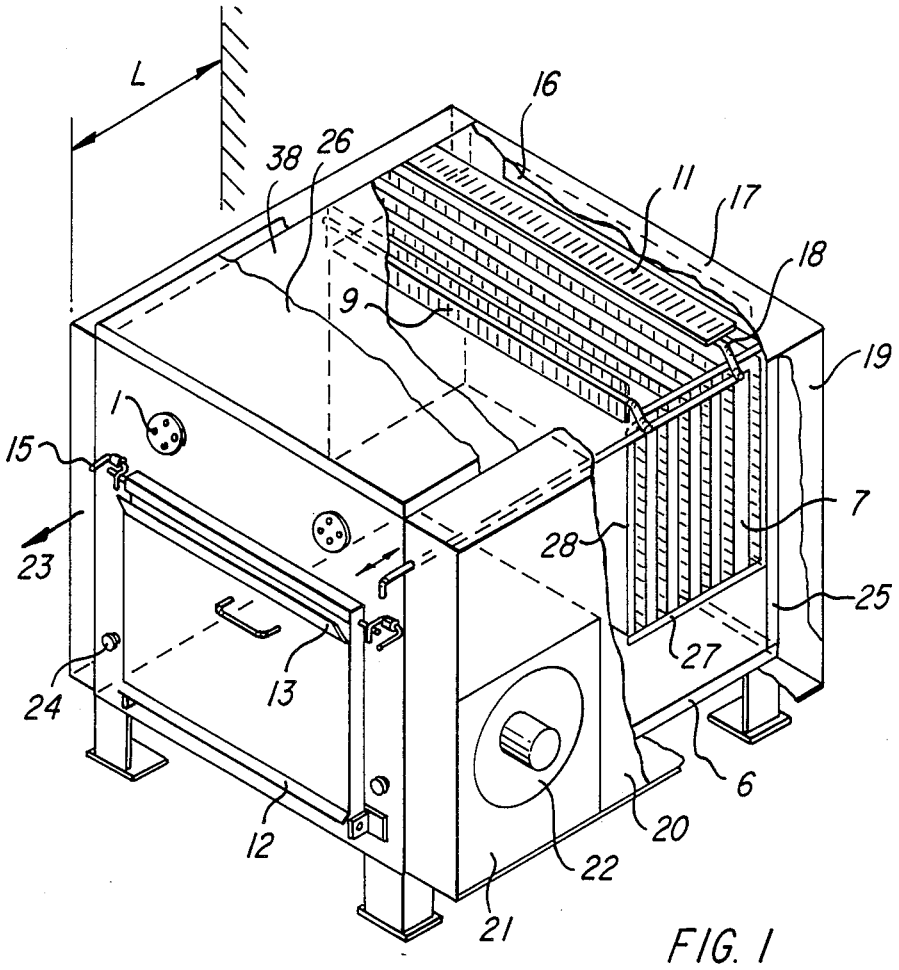
FIG. 1—Isometric view of the stove heater with parts of external covers and internal walls cut-out to show the general position of the plate heat exchanger and the flue gas control flaps.
Figure 2:
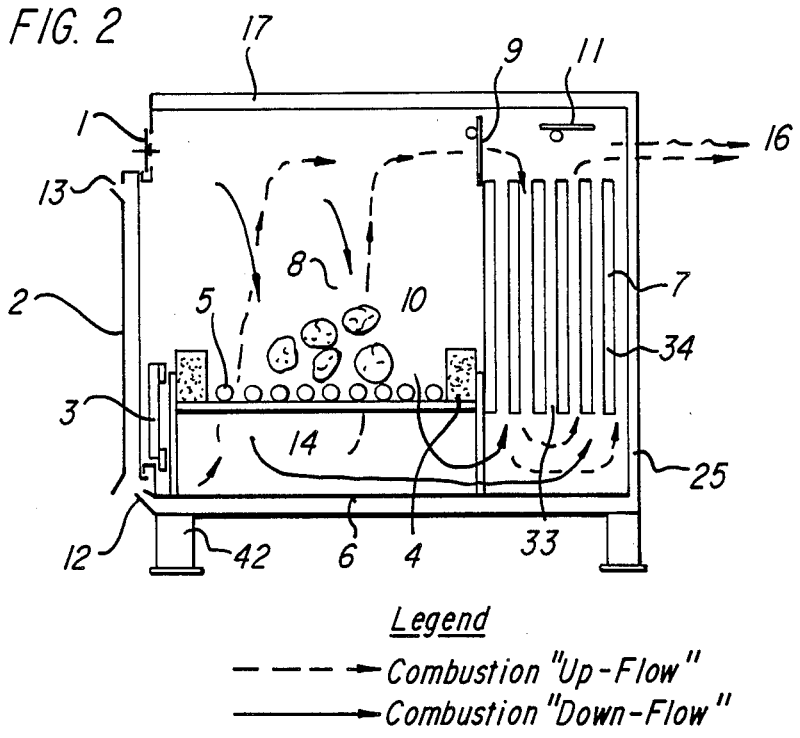
FIG. 2—Cross-section of the stove heater.

In the preferred embodiment the stove heater is assembled from preshaped sheets with matching flanges so as to form air jackets on its sides i.e. (6) bottom, (26) top, (19) right side cover and (38) left side cover. The charge door is also jacketed with and induced air inlet (12) and outlet air deflector (13). The heat exchanger (7) is mounted in a horizontal position by means of mounting flanges (28) which are sealed with the aid of high temperature gaskets and locked with "U" shaped locking strips or just screws. Grates (5) are inserted to occupy the remaining space of the stove at a level about the same as the bottom of the plate heat exchanger. Fire bricks (4) are placed around the fire walls. An external plate of the heat exchanger serves as the internal dividing fire wall (10), which can be made either from thicker plate or stainless steel, also a replaceable plate could be positioned to protect the heat exchange plate from the intense heat from the adjacent fire. A removable ash gate (3) serves to seal off the hearth form the pit (14) which also serves as a combustion chamber in the "down-flow" combustion made of operation. During the "down-flow" operation primary combustion air is admitted through regulators (1) above the wood charge and drawn into the hearth downwards by the chimney draft pulling from beneath the grates, secondary combustion air is added through all regulators (24) to the ash chamber (14) so as to ensure full combustion. The combusted gases are then passed upward through the flue gas passages (33) of the heat exchanger (7) and expelled through the flue gas exhaust (16), in the direction shown by the continuous line in FIG. 2.

During the start up of the fire the position of the flaps (9) and (11) are changed by 90 degrees. This is done by means of an interconnected lever system (18) so that "up-flow" combustion on the grates can take place. It should be noted that an intermediate position of the flaps (9) and (11) will establish a mixed air flow system i.e. "up and down" combustion, if necessary.

Figure 3:
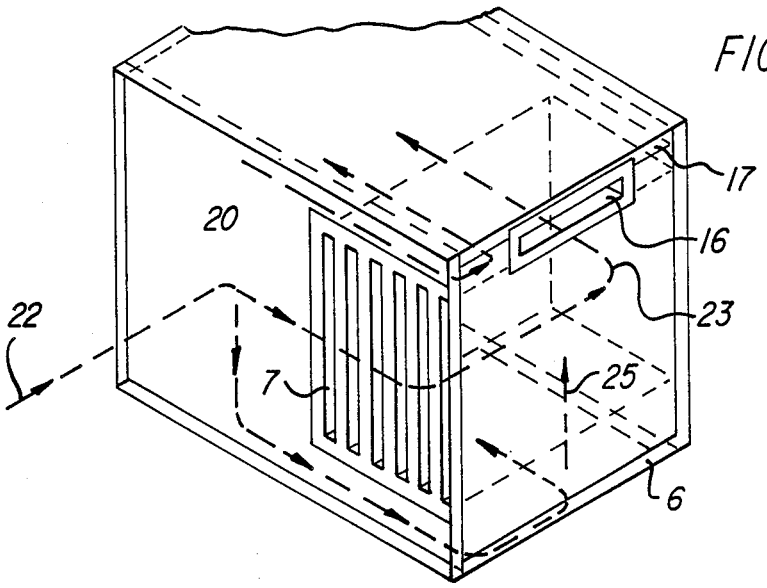
FIG. 3—Isometric view of the stove heater with the side covers removed to show distribution of cooling air flow.
Figure 4:
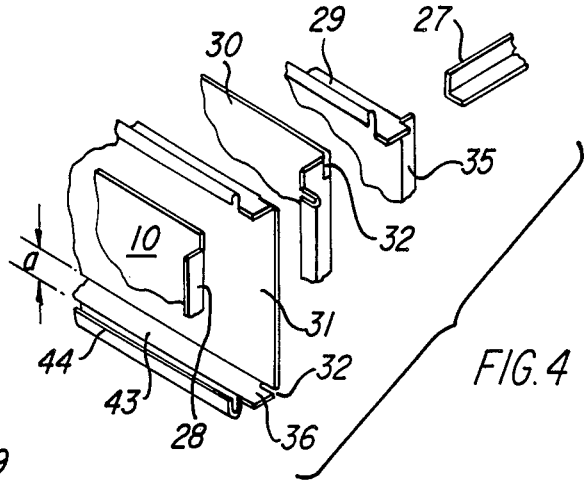
FIG. 4—Isometric view of the plate heat exchanger plate in exploded position showing the method of locking plates together.
Figure 5:
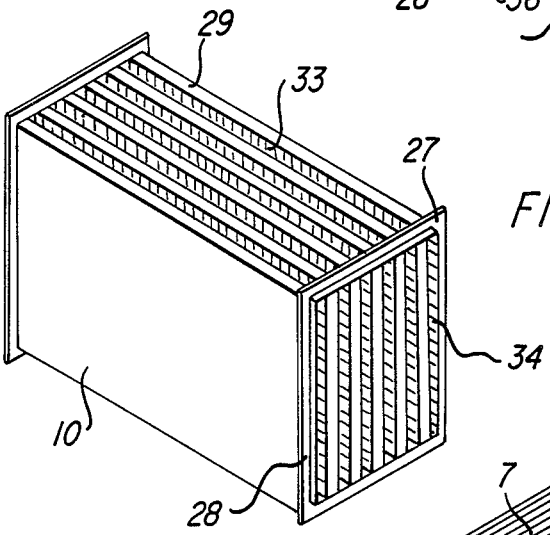
FIG. 5—Isometric view of the plate heat exchanger fully assembled.

The stove heater air cooling fan (22) which circulates the room air is mounted by means of a flange (21) of the removable side cover (19). The fan establishes an air pressure in the inlet plenum (20) wherefrom the cooling air is pushed through the heat exchanger ducts (34) to the other side of the stove where it is contained by the heat exchanger outlet header (23) and hence released into the room. This warm air could also be piped away to other rooms if required. A part of the air is passed through the bottom air jacket (6) and then exhausted below the charge door so as to induce cooling of the door . Another part of the cooling air is channelled through the back wall air jacket (25) and then through the top air jacket (17) and then released into the room as shown in FIG. 3.

The heating stove may either be used as a free standing heater supported on legs (42), or the legs may be omitted if the stove is intended to be inserted into a fire place. In this case the walls of the stove must be sealed against the fire place peripheral walls to prevent draft leakage. The distance "L" the stove may pertrude from the fire place can be adjusted according to the space requirements.

PREFERRED METHOD OF MANUFACTURE OF THE PLATE HEAT EXCHANGER

The plate heat exchanger is essentially made of metal plates with locking flanges on two opposing sides of the plates. The neighboring plates are shown in FIG. (4), an isometric exploded view of one corner of the exchanger. Each plate (31) after appropriate notching and bending has two flanges (43) having its width "a" equal to the spacing of the heat exchanger plates. The edge of each flange is bent in such a fashion as to form a "U" shaped closure (44) which locks onto the unbent edge of the neighboring plate (30). Each plate is attached in a position rotated by 90 degrees from its neighbor. Only one type of plate is required to assemble the heat exchanger. However, in the case of the stove heater a heat exchanger of rectangular rather than square shape is preferred. In this case two types of plates are required i.e. one set with horizontal flanges and one set with vertical flanges. Further, in order to facilitate attaching of the mounting flanges to the heat exchanger, tails (36) are formed during the plate notching operation. These tails can be brazed or welded on to the angular flange (27). It should be further observed that notches (32) are required to allow the lips of "U" type locks on the flange to pass through during the assembly. The end plates (10) and (29) of the heat exchanger also differ from the core building plates (30) and (31). Namely, the end plate (10) has a flange (28) formed there on which serves as a mounting flange, while the other end plate (29) has an additional flange (35) bent on each opposing end. It should be observed that the end flanges should be made of thicker material since they also perform the additional role of attaching the heat exchanger to the fire side walls of the stove.

METHODS OF MOUNTING THE HEAT EXCHANGER WITHIN A FIREPLACE

Figure 6:
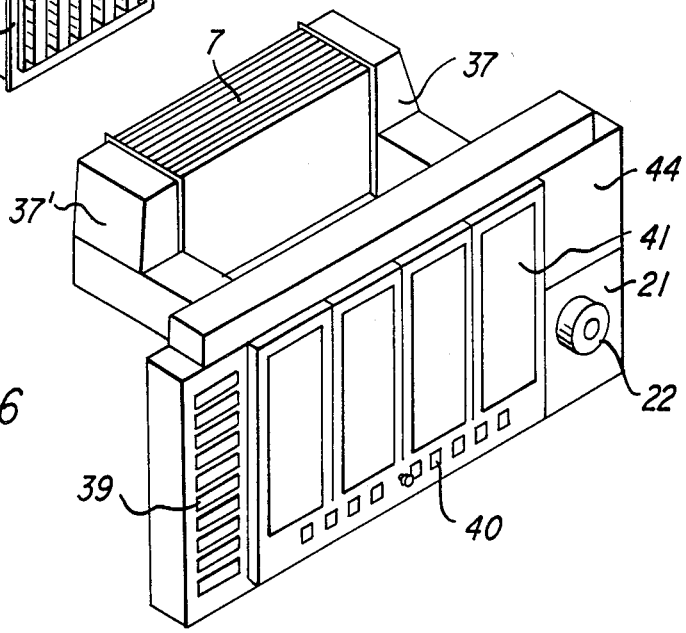
FIG. 6—Isometric view of another embodiment of the heat exchanger mounted inside the fire place without the external shell.

Another embodiment of the heat exchanger it to mount is directly in the hearth of a fireplace as shown in FIG. 6. To each end of the heat exchanger, air ducts (37) and (37) are attached which connect to externally mounted inlet and outlet boxes (44) and (39). As in the case of the first embodiment of the stove a heater fan (22) is mounted by means of the flange (21) in the box (44). Such an embodiment allows room air to circulate through the heat exchanger. A further improvement to such an embodiment is the addition or metal of glass doors (41) to prevent the warm room air from escaping up the chimney. Combustion air is regulated by means of slots (40).

What is claimed:

1. A heating stove comprising: a combustion chamber, a grate for fuel disposed in the combustion chamber, upper and lower combustion air inlets to provide a bottom air feed upwardly through fuel from below the grate, and downwardly through fuel from above the fuel, a heat exchanger including a series of vertically oriented horizontally spaced metal plates means for interconnecting said plates to form a set of vertical passages conducting the products of combustion and a set of horizontal passages conducting a flow of air to be heated, top and bottom passageways above and below said series of plates through which the plates communicate with the combustion chamber, two flow control adjustable baffles above the plates in the top passageway, one of the baffles being disposed centrally of the series of plates, the other of the baffles controlling flow from the combustion chamber, and an outlet connecting a downstream end of the top passageway to a flue.

2. A heating stove according to claim 1, including means for jointly operating the flow control adjustable baffles providing down flow combustion when the one baffle is horizontal and the other baffle is vertical, providing upflow combustion when the one baffle is vertical and the other baffle is horizontal, and providing a mixed flow combustion in intermediate positions.

3. A heat exchanger, comprising: a series of vertically oriented, horizontally spaced metal plates, each of said plates having first mutually opposite unbent edges and second mutually opposite edges with flanges formed thereon protruding perpendicularly to said plates, said first and second opposite edges being alternating horizontal and vertical edges throughout said series of plates, each of said flanges having a U-shaped outer edge receiving an unbent edge of the adjacent plate, said plates being interconnected exclusively by direct engagement of said unbent edges with said U-shaped outer edges, and each of said flanges having notches formed therein defining a tail permitting attachment of said plates, said flanges spacing said plates apart to form a set of vertical passages conducting the products of combustion and a set of horizontal passages conducting a flow of air to be heated.

4. A heating stove for operation with a fire place, comprising an air inlet box to be placed at the entrance to a fire place, a fan forcing air from a room into said air inlet box, an inlet air duct connected downstream of said inlet box as seen in air flow direction, a plate heat exchanger connected downstream of said inlet air duct to be placed above fuel in the fire place, an outlet air duct connected downstream of said plate heat exchanger, and an air outlet box connected downstream of said outlet air duct for discharging heated air to a room.

5. Stove heater according to claim 4, wherein said plate heat exchanger has a series of mutually spaced-apart plates defining vertical passageways for conducting flue gases upwardly therethrough and horizontal passageways interconnecting said air ducts.

6. Stove heater according to claim 5, wherein each of said plates have first mutually opposite unbent edges and second mutually opposite edges with flanges formed thereon protruding perpendicularly to said plates, said first and second opposite edges being alternating horizontal and vertical edges throughout said series of plates, each of said flanges having a U-shaped outer edge receiving an unbent edge of the adjacent plate, said plates being interconnected exclusively by direct engagement of said unbent edges with said U-shaped outer edges, and each of said flanges having notches formed therein defining a tail permitting attachment of said plates.

7. Stove heater according to claim 4, including a frame in which said inlet and outlet boxes are disposed, and doors disposed in said frame.

8. Stove heater according to claim 7, wherein said frame has slots formed therein for regulating air flow.

* * * * *